US011162338B2

(12) United States Patent
Brown et al.

(10) Patent No.: US 11,162,338 B2
(45) Date of Patent: Nov. 2, 2021

(54) ELECTRIC SUBMERSIBLE PUMP (ESP) INTAKE CENTRALIZATION

(71) Applicant: Halliburton Energy Services, Inc., Houston, TX (US)

(72) Inventors: Donn J. Brown, Broken Arrow, OK (US); Casey Laine Newport, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 59 days.

(21) Appl. No.: 16/743,760

(22) Filed: Jan. 15, 2020

(65) Prior Publication Data

US 2021/0215024 A1 Jul. 15, 2021

(51) Int. Cl.

| | |
|---|---|
| ***E21B 43/12*** | (2006.01) |
| ***E21B 17/10*** | (2006.01) |
| ***E21B 43/38*** | (2006.01) |
| ***E21B 47/008*** | (2012.01) |

(52) U.S. Cl.

CPC ..... *E21B 43/128* (2013.01); *E21B 17/1078* (2013.01); *E21B 43/38* (2013.01); *E21B 47/008* (2020.05)

(58) Field of Classification Search

CPC ..... E21B 43/13; E21B 43/38; E21B 43/128; E21B 47/008

See application file for complete search history.

(56) References Cited

U.S. PATENT DOCUMENTS 5,107,927 A * 4/1992 Whiteley ..... E21B 17/10 166/227
5,588,486 A 12/1996 Heinrichs
6,367,556 B1 * 4/2002 Moore ..... E02D 5/805 166/241.1
9,494,022 B2 11/2016 Coates et al.

(Continued)

FOREIGN PATENT DOCUMENTS

GB 2475074 A 5/2011
WO 2016205100 A1 12/2016

(Continued)

OTHER PUBLICATIONS

Foreign Communication from Related Application—International Search Report and Written Opinion of the International Searching Authority, International Application No. PCT/US2020/014787, dated Oct. 8, 2020, 14 pages.

(Continued)

*Primary Examiner* — David Carroll
(74) *Attorney, Agent, or Firm* — Conley Rose, P.C.; Rodney B. Carroll

(57) ABSTRACT

An electric submersible pump (ESP) assembly. The ESP assembly comprises a pump intake defining a plurality of intake ports disposed circumferentially around the pump intake, a first plurality of centralizer wings disposed radially about the pump intake on a downhole side of the intake ports, a second plurality of centralizer wings disposed radially about the pump intake on an uphole side of the intake ports, and a self-orienting sleeve disposed around the intake ports, captured by the first and second plurality of centralizer wings, and free to hang down on upward facing intake ports when the ESP assembly is disposed in a horizontal or offset position.

20 Claims, 13 Drawing Sheets

(56) References Cited

U.S. PATENT DOCUMENTS

| | | | | |
|---|---|---|---|---|
| 10,920,560 | B2 * | 2/2021 | Raglin | E21B 43/38 |
| 2001/0004017 | A1 | 6/2001 | Lopes | |
| 2003/0111230 | A1 | 6/2003 | Olson et al. | |
| 2005/0173114 | A1 | 8/2005 | Cudmore et al. | |
| 2007/0051509 | A1 * | 3/2007 | Selph | E21B 43/38 166/105 |
| 2010/0096140 | A1 * | 4/2010 | Mack | E21B 43/128 166/369 |
| 2010/0319911 | A1 | 12/2010 | Reid et al. | |
| 2015/0275643 | A1 | 10/2015 | Holder et al. | |
| 2016/0281486 | A1 | 9/2016 | Obrejanu | |
| 2017/0096889 | A1 * | 4/2017 | Blanckaert | E21B 47/06 |
| 2017/0138167 | A1 | 5/2017 | Wang et al. | |
| 2020/0308940 | A1 * | 10/2020 | Hill | E21B 43/121 |

FOREIGN PATENT DOCUMENTS

| | | | |
|---|---|---|---|
| WO | 2018164962 | A1 | 9/2018 |
| WO | 2019173909 | A1 | 9/2019 |

OTHER PUBLICATIONS

Foreign Communication from Related Application—International Search Report and Written Opinion of the International Searching Authority, International Application No. PCT/US2018/048572, dated May 27, 2019, 9 pages.

Foreign Communication from Related Application—International Search Report and Written Opinion of the International Searching Authority, International Application No. PCT/US2018/054703, dated Jul. 4, 2019, 11 pages.

Cover Sheet and Specification for International Application entitled "Gas Separator with Fluid Reservoir and Self-Orientating intake," filed Oct. 5, 2018 as International Application No. PCT/US2018/054703.

Cover Sheet and Specification for International Application entitled "Electrical Submersible Pump (ESP) String and ESP Orientation System," filed Aug. 29, 2018 as International Application No. PCT/US2018/048572.

* cited by examiner

ELECTRIC SUBMERSIBLE PUMP (ESP) INTAKE CENTRALIZATION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubblepoint, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump) coupled to production tubing. These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
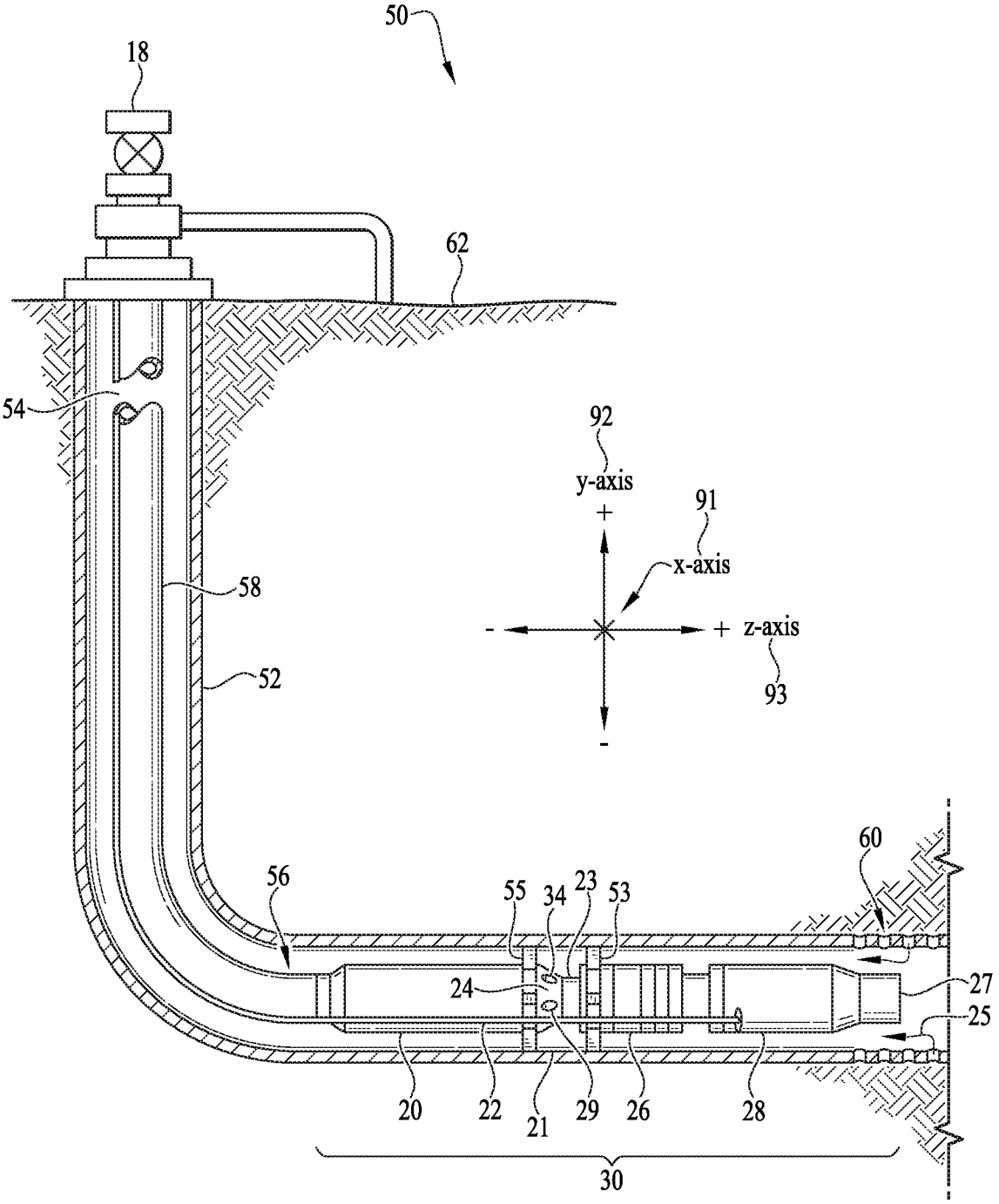
FIG. 1A and FIG. 1B are an illustration of an electric submersible pump (ESP) assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. "Downhole" is directed counter to the direction of flow of well fluid, towards the source of well fluid. "Uphole" is directed in the direction of flow of well fluid, away from the source of well fluid. As used herein, radial movement or direction refers to movement or direction that is perpendicular to (i.e., making a 90 degree angle with) the central axis of an ESP assembly at the associated location in the ESP assembly (for example, at an electric motor of an ESP assembly, at a centrifugal pump of an ESP assembly). As used herein, transversely displaced refers to displacement along a central axis of an ESP assembly, for example displacement or translation upwards substantially parallel to the central axis of the ESP assembly or displacement or translation downwards substantially parallel to the central axis of the ESP assembly.

The reservoir fluids that enter a pump intake of an electric submersible pump (ESP) assembly may sometimes comprise a gas fraction. These gases may flow upwards through the liquid portion of the reservoir fluid in a centrifugal pump of the ESP assembly. The gases may even separate from the other fluids when the pump is in operation. If a large volume of gas enters the pump, or if a sufficient volume of gas accumulates on the suction side of the pump, the gas may interfere with normal operation of the pump and potentially prevent the intake of the reservoir fluid into the pump. This phenomenon is sometimes referred to as a "gas lock" because the centrifugal pump may not be able to operate properly due the accumulation of gas within the pump.

In a horizontal portion of a wellbore a multi-phase (e.g., gas and one or more liquid phases) reservoir fluid may naturally separate into a gas phase fluid and a liquid phase fluid where the gas is disposed on top of the liquid. When the ESP assembly is disposed horizontally in the wellbore, the ESP assembly may lay on the casing on the lower side of the wellbore. As the reservoir fluid segregated into gas and liquid flow to and past the downhole end of the ESP assembly, the liquid is at least partially blocked by the ESP assembly and the flow of the liquid increases in speed. This increased speed may induce turbulent flow of the liquid that may lead to remixing of the liquid and the gas. It is an insight of the inventors that configuring the ESP assembly and/or the pump intake so as to promote laminar (smooth, non-turbulent) flow of the segregated liquid and gas in the horizontal wellbore at the pump intake can be advantageously used to selectively admit liquid into the pump intake and exclude gas from the pump intake.

Centralizing wings, as described further hereinafter, disposed around the pump intake keep the pump intake up away from the lower side of the wellbore casing, allowing laminar flow of liquid on the lower side of the wellbore casing. In one embodiment, a self-orienting sleeve is positioned by centralizing wings disposed on an uphole side and on a downhole side of the pump intake and is free to hang down and close at least partially upper ports of the pump intake which otherwise would admit gas and open lower ports of the pump intake to admit fluid (e.g., liquid) into the pump intake. Because the centralizing wings keep the pump intake up away from the lower side of the pump inlet and the sleeve is open at both ends, the laminar flow of liquid fluid is not disturbed by the pump intake and the segregation between the liquid fluid and the gas fluid that naturally occurs in the horizontal portion of wellbore is maintained. In another embodiment, a positon of the ESP assembly as it is run into the horizontal portion of the wellbore is controlled such that a preferred orientation of a pump intake of the ESP assembly is established. The upper side of the pump intake of this embodiment is solid and has no ports which otherwise would admit gas. The lower side of the pump intake has ports which admit liquid. The pump intake of this other embodiment also has centralizing wings which keep the pump intake up away from the lower side of the wellbore casing, allowing laminar flow of liquid on the lower side of the wellbore casing. In this way, the ESP assemblies taught herein can take advantage of the horizontal disposition of the ESP assembly and the natural segregation of the multi-phase reservoir fluid into its liquid phase and its gas phase in the horizontal portion of wellbore to keep unwanted gas out of the centrifugal pump.

Turning now to FIG. 1A, a production system 50 is described. In an embodiment, the system 50 comprises an electric submersible pump (ESP) assembly 56 located in a substantially deviated or horizontal zone or portion 30 of a wellbore 54. FIG. 1A provides a directional reference comprising three coordinate axes—an X-axis 91 where positive displacements along the X-axis 91 are directed into the sheet and negative displacements along the X-axis 91 are directed out of the sheet; a Y-axis 92 where positive displacements along the Y-axis 92 are directed upwards on the sheet and negative displacements along the Y-axis 92 are directed downwards on the sheet; and a Z-axis 93 where positive displacements along the Z-axis 93 are directed rightwards on the sheet and negative displacements along the Z-axis 93 are directed leftwards on the sheet. The Y-axis 92 is about parallel to a central axis of a vertical portion of the wellbore 54. In an embodiment, a central axis of the portion 30 of the wellbore 54 may be about parallel to the Z-axis 93. Alternatively, in an embodiment, the central axis of the portion 30 of the wellbore 54 may be about +/−5, 10, 15, 20, 25, 30, 35, 40, or 45 degrees of parallel to the Z-axis 93. The negative direction of the Y-axis 92 may point to the center of the Earth, and the positive direction of the Y-axis 92 may point 180 degrees away from the center of the Earth. The Z-axis 93 is about perpendicular to the X-axis 91 and about perpendicular to the Y-axis 92. The X-axis 91 is about perpendicular to the Y-axis 92 and about perpendicular to the Z-axis 93. The Y-axis 92 is about perpendicular to the X-axis 91 and about perpendicular to the Z-axis 93.

While the ESP assembly 56 is illustrated in FIG. 1A as close to the transition to a substantially vertical wellbore 54, it is understood that the ESP assembly 56 may be located deep into the horizontal zone 30 of the wellbore 54, for example hundreds feet away or thousands of feet away from a transition to a vertical portion of the wellbore 54. The ESP assembly 56 is coupled to a production tubing 58 and is disposed within a casing 52. A lower side 21 of the casing 52 is located displaced a negative distance along the Y-axis 92 relative to a centerline of the ESP assembly 56 in the horizontal zone 30. Perforations 60 in the casing 52 admit reservoir fluid 25 to enter the wellbore 54, and the ESP assembly 56 pumps the fluid through the production tubing 58 to a wellhead 18 located at a surface 62. In an embodiment, the ESP assembly 56 comprises a centrifugal pump 20, an electric cable 22 (e.g., a motor lead extension (MLE)), a pump intake 24, a seal section 26, an electric motor 28, and a sensor package 27. An upper side 23 of the pump intake 24 is located in the positive direction along the Y-axis 92 from a centerline of the pump intake 24. The pump intake 24 comprises a plurality of ports including one or more port 34 open away from the center of the earth (e.g., on the upper side 23 of the pump intake 24) and one or more port 29 open toward the center of the earth. In embodiments, the ESP assembly 56 may comprise additional components, for example a second centrifugal pump.

The electric cable 22 provides electric power to the electric motor 28. The electric motor 28 converts the supplied electric power to torque that is delivered to the centrifugal pump 20 through one or more drive shafts. The centrifugal pump 20 converts the torque received from a drive shaft to turn a series of impellers disposed in corresponding statically located diffusers to generate lifting pressure. In an embodiment, the electric cable 22 may further provide a communication link between an operating station at the surface and the sensor package 27, for example using power line communication (PLC) techniques or other communication techniques.

The ESP assembly 56 further comprises a plurality of downhole centralizers 53 disposed downhole of the pump intake 24 and a plurality of uphole centralizers 55 disposed uphole of the pump intake 24. In an embodiment, the downhole centralizers 53 may comprise four separate centralizer wings disposed about evenly around the circumference of the ESP assembly 56, for example about every 90 degrees rotationally. The uphole centralizers 55 may comprise four separate centralizer wings disposed about evenly around the circumference of the ESP assembly 56, for example about every 90 degrees rotationally. When the ESP assembly 56 is horizontally disposed in the horizontal zone 30 of the wellbore 54, the centralizers 53, 55 keep the pump intake 24 up off the lower side 21 of the casing 52 and up out of a fluid flow in the casing 52, thereby promoting laminar flow of the fluid in the horizontal portion of the wellbore 30 proximate the ESP 56 and reducing the risk that the separated liquid will remix with gas. The centralizers 53, 55 centralize the location of the pump intake 24 inside the casing 52, and thereby provide a flow path on the upper side of the intake 24 for the gas phase to flow and a flow path on the lower side of the intake 24 for the liquid phase to flow.

The centralizers 53, 55 may be formed of metal, for example stainless steel metal, carbide metal, titanium metal, or another metal. The centralizers 53, 55 may be dimensioned to hold the pump intake 24 about 0.2, 0.3, 0.4, 0.5, 0.6, 0.7, 0.8, 0.9, 1.0, 1.2, 1.4, 1.5, 1.75, 2.0 inches or some other distance away from the casing 52. It is understood that the dimensioning of the centralizers 53, 55 may be different in casing 52 having different diameters. It is understood that the centralizers 53, 55 may be dimensioned so that the ESP assembly 56 fits within the inside diameter of the casing 52 and is able to be run-in and pulled-out of the casing 52 around any doglegs and bends that may be present in the wellbore 54. While centralizers 53, 55 are shown proximate to the pump intake 24 (e.g., within about 6, 12, 18, 24, 30, or 36 inches on either side), in an aspect additional centralizers may be located at other points along the ESP assembly 56. Additional centralizers may be located on the sensor package 27, on the electric motor 28, on the seal section 26, on the centrifugal pump 20, and/or at one or more connections or couplings between such components, whereby the centralizers are configured and effective to centralize and lift each of these components of the ESP assembly 56 up off of the lower side 21 of the casing 52 (i.e., the side closest to the center of the earth in the horizontal zone 30).

Figure 1B:
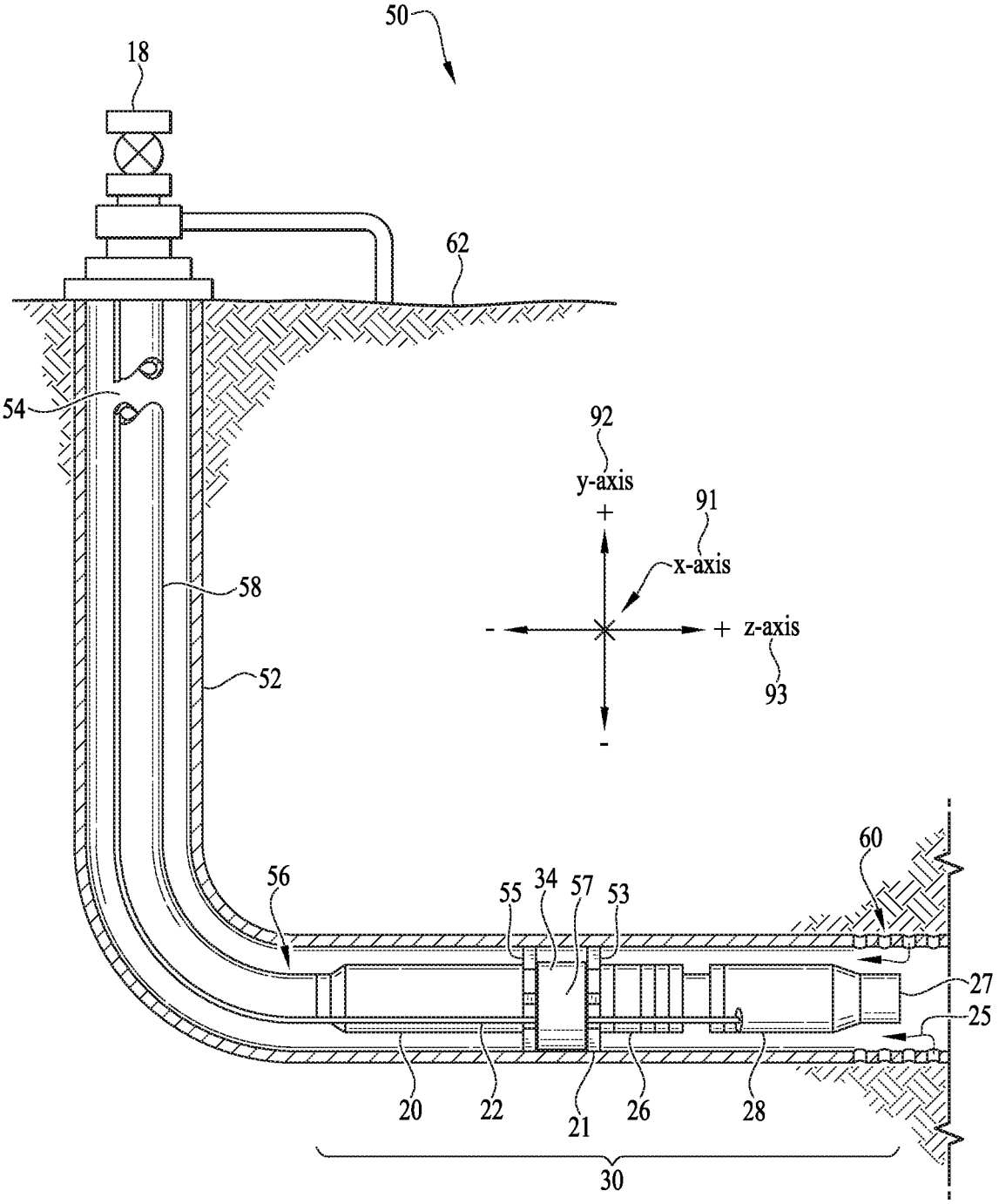

Turning now to FIG. 1B, further details of the ESP assembly 56 are described. As better seen in FIG. 1B, the ESP assembly 56 comprises a self-orienting sleeve 57 that is positioned between the downhole centralizers 53 and the uphole centralizers 55. The self-orienting sleeve 57 can be a metal cylinder of about circular cross-section that has a larger diameter than the pump intake 24 (hidden in FIG. 1B by the sleeve 57). The self-orienting sleeve 57 may be made of iron, of steel, of stainless steel, of carbide metal, or titanium metal, or of some other metal. When the ESP assembly 56 is disposed in the horizontal zone 30 of the wellbore 54, the self-orienting sleeve 57 hangs down (toward the center of the earth, in the negative direction along the Y-axis 92) from the upper side 23 of the pump intake 24, thereby sealing or partially blocking ports of the pump intake 24 at the upper side 23 of the pump intake 24 (e.g., ports 25 that open away from the center of the and leaving open ports of the pump intake 24 at the lower side of the pump intake 24 (e.g., ports 29 that open towards the center of the earth). The upper intake ports may also be identified as positioned a radial distance above a central axis of the ESP assembly 56 and the lower intake ports may also be identified as positioned a radial distance below a central axis of the ESP assembly 56. The self-orienting sleeve 57 may block or mitigate flow of gas into the pump intake 24 by reducing a flow path of the gas between the self-orienting sleeve 57 and the pump intake 24 as best seen in FIG. 2E described below.

The self-orienting sleeve 57 is said to be self-orienting because the force of gravity acting in the horizontal zone 30 of the wellbore causes the self-orienting sleeve 57 to hang down towards the center of the earth and away from the surface 62 independently of the rotational disposition of the ESP assembly 56 in the casing 52, for example when insertion of the ESP assembly 56 into the wellbore 54 when rotational orientation of the ESP assembly 56 and of the pump intake 24 are not controlled. Because the self-orienting sleeve 57 is bigger in diameter than the pump intake 24, a gap exists between the self-orienting sleeve 57 and the pump intake 24. Because the force of gravity causes the self-orienting sleeve 57 to hang downwards, in the negative direction of the Y-axis 92, towards the center of the earth, the gap is smaller on an upwards side of the pump intake 24 and larger on a downwards side of the pump intake 24. In production, liquid flows out of the formation through the perforations 60 as shown by arrow 25 towards the pump intake 24, flows into an opening or gap between the self-orienting sleeve 57 and the pump intake, as best seen in FIG. 2E described below, without being blocked by the self-orienting sleeve 57, flows smoothly into the pump intake 24, and flows into the centrifugal pump 20, without agitating the fluid and causing it to remix with separated gas. By contrast, gas that is disposed in the upper side of the horizontal zone 30 of the wellbore 54 is prevented from entering or is reduced in rate of entering the pump intake 24 because the upper portion of the self-orienting sleeve 57 that is in contact with the pump intake 24 blocks all or a portion of intake openings located on the top of the pump intake 24.

Figure 2A:
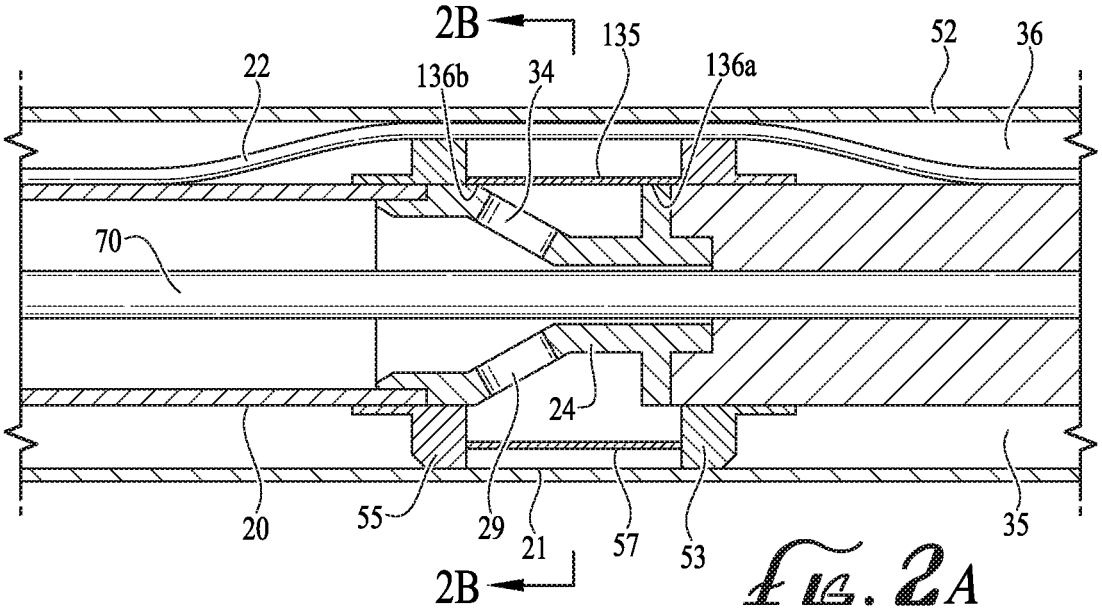
FIG. 2A, FIG. 2B, FIG. 2C, FIG. 2D, and FIG. 2E are illustrations of a self-orienting sleeve of an ESP assembly according to an embodiment of the disclosure.
Figure 2B:
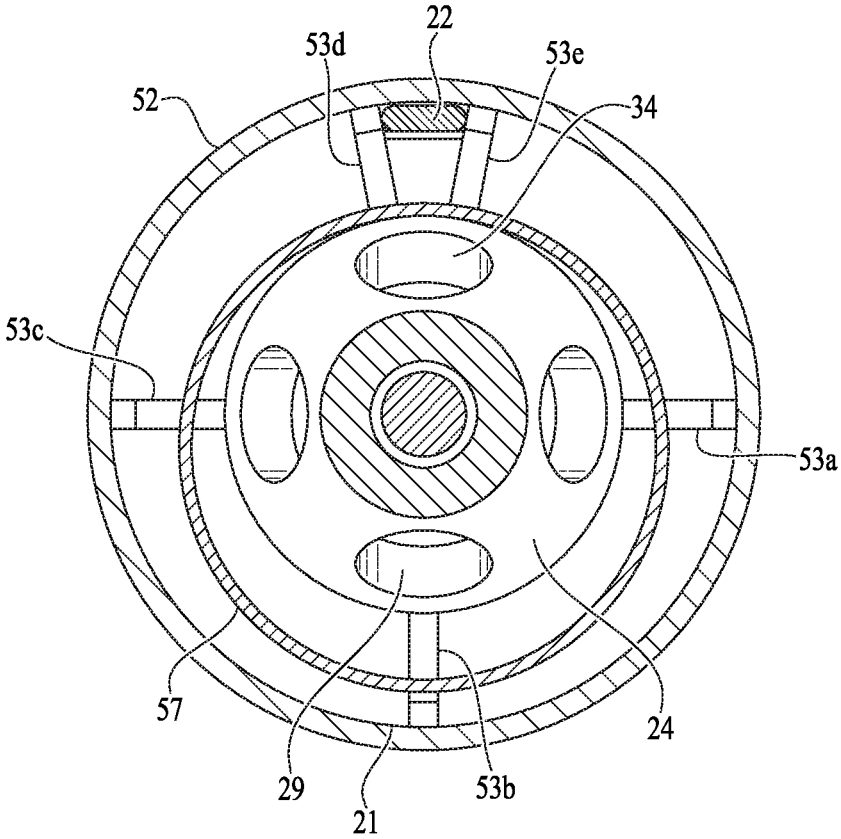

Turning now to FIG. 2A and FIG. 2B further details of the ESP assembly 56 are described. The downhole centralizers 53 may comprise a first centralizer 53*a*, a second centralizer 53*b*, a third centralizer 53*c*, a fourth centralizer 53*d*, and a fifth centralizer 53*e*. In an embodiment, the electric cable 22 is disposed between the fourth centralizer 53*d* and the fifth centralizer 53*e*, and an outside edge of the electric cable 22 is inside the outer edge of the fourth and fifth centralizers 53*d*, 53*e*. In this way, the fourth and fifth centralizers 53*d*, 53*e* may protect the electric cable 22 from harmful impacts with the casing 52. The positioning of the self-orienting sleeve 57, e.g., between centralizers 53 and 55, may also be seen in FIG. 2A. The uphole centralizers 55 may likewise be disposed similarly to the centralizers 53*a*, 53*b*, 53*c*, 53*d*, 53*e* (e.g., as shown in FIG. 2B) only on the uphole side of the pump intake 24. The inside diameter of the self-orienting sleeve 57 is less than the diameter defined by the outside edges of the centralizers 53, 55 that are proximate (e.g., in contact with) the inner surface of casing 52. In FIG. 2A, it can be seen how an upwards facing portion 135 of the self-orienting sleeve 57 (facing way from the center of the earth, up towards the surface 62 when the ESP assembly 56 is disposed in the horizontal zone 30 of the wellbore 54) contacts a downhole outer edge 136*a* of the pump intake 24 and on an uphole outer edge 136*b* of the pump intake 24. Gas in an upper part 36 of the casing 52 in the horizontal zone 30 would be blocked or mitigated from entering where the upwards facing portion 135 of the self-orienting sleeve 57 contacts the edges 136*a*, 136*b* of the pump intake around the edge of the self-orienting sleeve 57. At the same time, liquid in a lower part 37 of the casing 52 would be allowed free entry to the pump inlet 24.

Figure 2C:
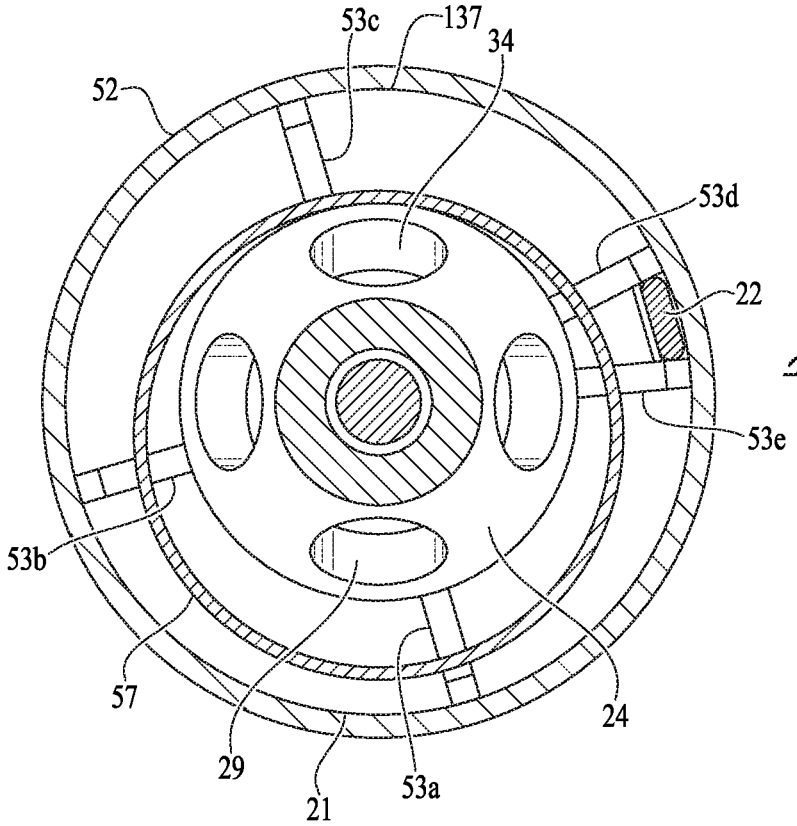
Figure 2D:
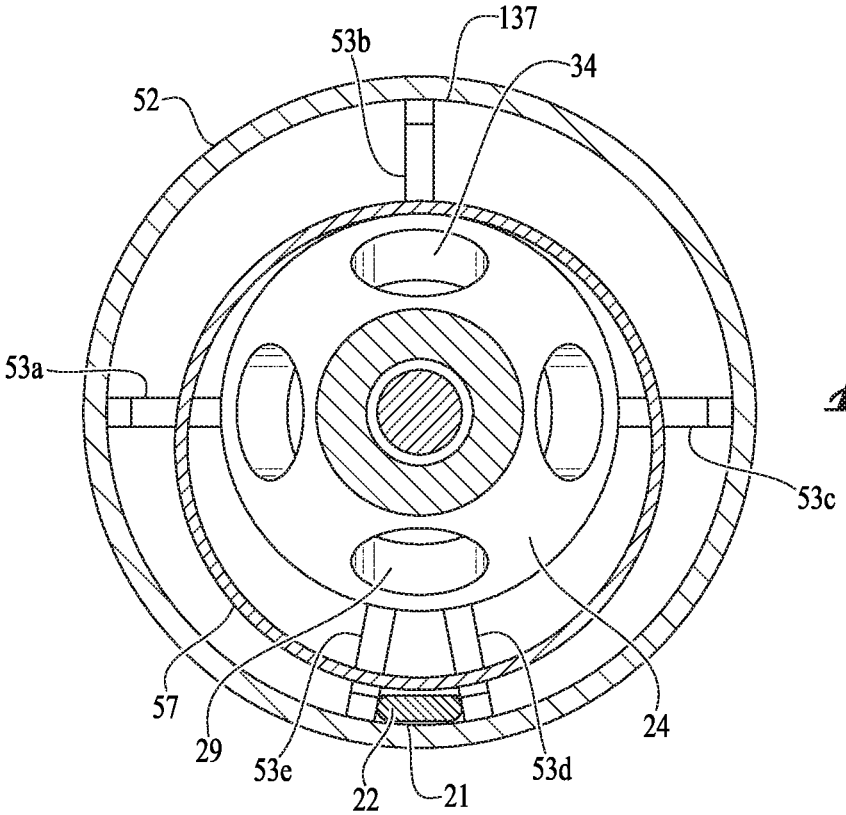
Figure 2E:
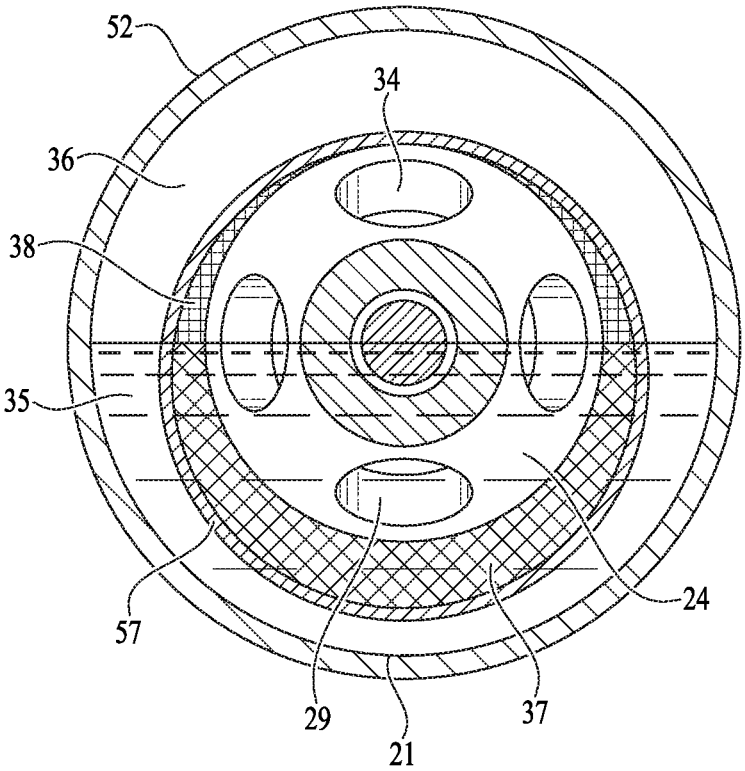

Turning now to FIG. 2C and FIG. 2D, the self-orienting sleeve 57 is shown in different rotated orientations of the ESP assembly 56. In FIG. 2C, the ESP assembly 56 is rotated so the electric cable 22 is not located proximate an upper side 137 of the casing 52 but between the upper side 137 and the lower side 21 of the casing 52. In FIG. 2D, the ESP assembly 56 is rotated so the electric cable 22 is located proximate the lower side 21 of the casing 52. In the ESP assembly 56 the rotational orientation in the run-in position may be random and uncontrolled. In this case, the electric cable 22 may be located in different positions relative to the horizontal zone 30 of the wellbore 54 and the self-orienting sleeve 57 hangs down as described above.

Turning now to FIG. 2E, the self-orienting sleeve 57 is shown in a context where the upper part 36 of the casing 52 is filled with gas while the lower part 37 of the casing 52 is filled with liquid (at least downhole of the pump intake 24). A first gap 38 in the upper part 36 of the casing 52 between the self-orienting sleeve 57 and the pump inlet 24 is depicted in FIG. 2E. A second gap 37 in the lower part 35 of the casing 52 between the self-orienting sleeve 57 and the pump inlet 24 is also depicted in FIG. 2E. The second gap 37 is greater in area than the first gap 38, hence the second gap 38 tends to restrict the flow of gas into the space between the self-orienting sleeve 57 and the pump inlet 24 while the first gap 37 tends to not restrict the flow of liquid into the space between the self-orienting sleeve 57 and the pump inlet 24.

Figure 3A:
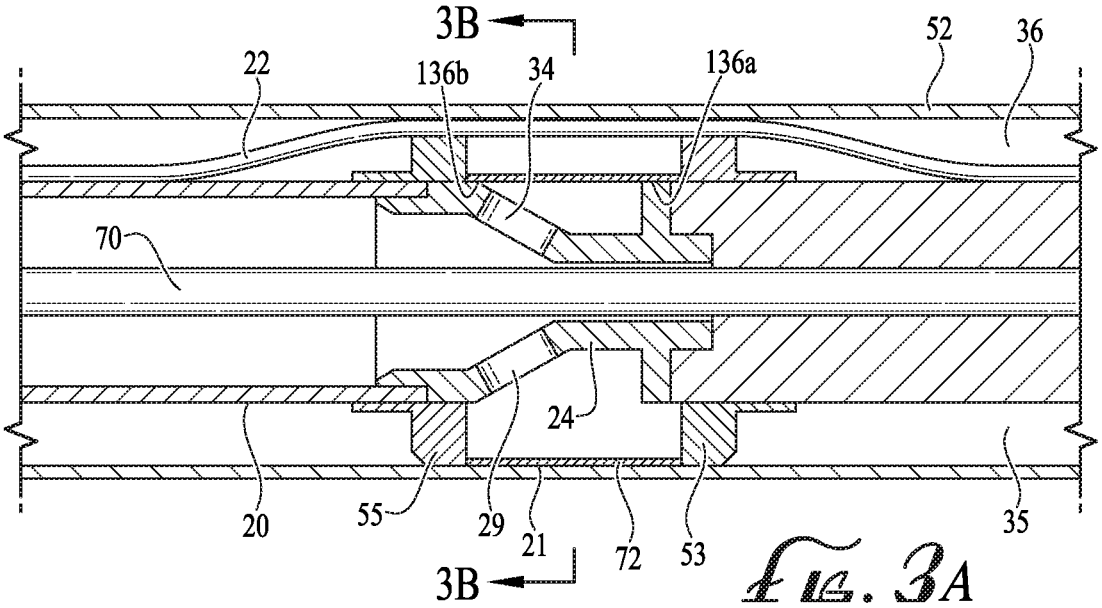
FIG. 3A, FIG. 3B, FIG. 3C, and FIG. 3D are illustrations of another self-orienting sleeve of an ESP assembly according to an embodiment of the disclosure.
Figure 3B:
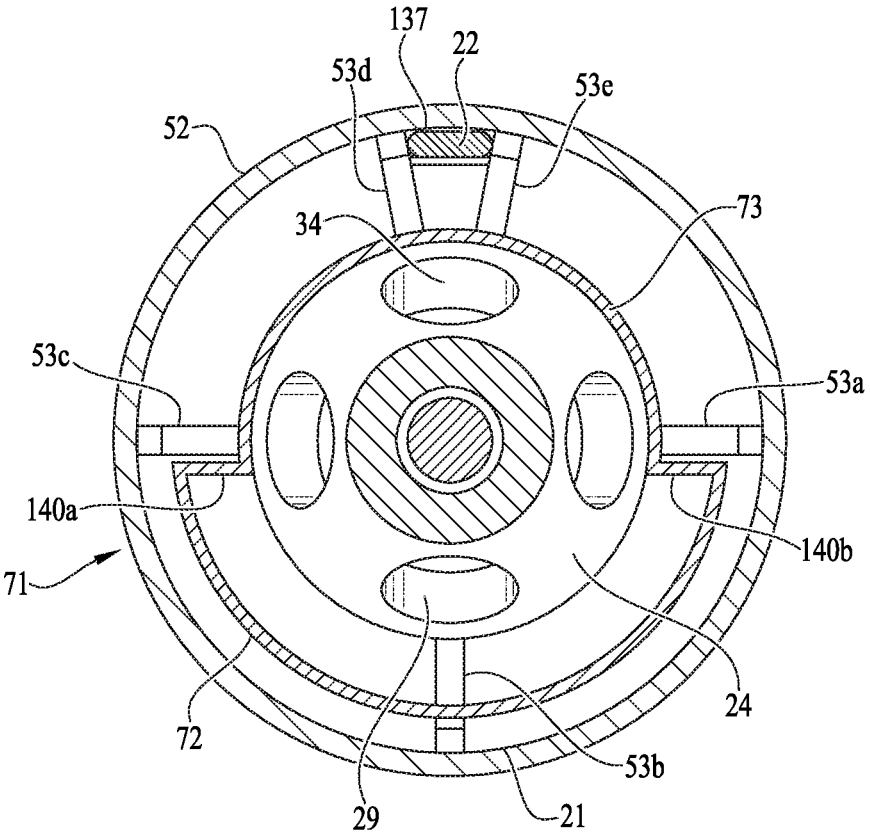

Turning now to FIG. 3A and FIG. 3B, an alternative self-orienting sleeve 71 is described. The X-axis 91, Y-axis 92, and Z-axis 93 coordinate axes illustrated in FIG. 1A and FIG. 1B apply to FIG. 3A and FIG. 3B. The self-orienting sleeve 71 has a first sleeve portion 73 having a semi-circular cross section having an inner radius (as measured from about a centerline axis of the ESP assembly 56) of about the size of the outer radius of the pump intake 24 and a second sleeve portion 72 having a semi-circular cross section having an inner radius (as measured from about a centerline axis of the ESP assembly 56) that is larger than the first sleeve portion 73 (e.g., slightly less radius (as measured from a centerline axis of the ESP assembly 56) than the position of the inner surface of the electric cable 22 as it passes between the centralizers 53*d*, 53*e*). The first sleeve portion 73 has a cross-section of a portion of a circle having a diameter about the same as the diameter of the pump intake 24. The second sleeve portion 72 has a cross-section of a portion of a circle having a diameter larger than the diameter of the pump intake 24 and having a radius less than the distance of the inner surface of the electric power cable 22 (e.g., a motor lead extension (MLE)) as it passes over the pump intake 24. The first and second sleeve portions 73, 72 are connected by connecting portions 140*a*, 140*b* of the self-orienting sleeve 71.

When the self-orienting sleeve 71 hangs down, the first sleeve portion 73 contacts the downhole outer edge 136*a* of the pump intake 24 and the uphole outer edge 136*b* of the pump intake 24. This contact is substantially continuous between the first sleeve portion 73 and the edges 136*a*, 136*b*, thereby substantially blocking in flow of gas in the upper part 36 of the casing 52. By contrast, the second sleeve portion 72 is disposed in the lower part 35 of the casing 52 and allows liquid to flow into the pump intake 24. Because the second sleeve portion 72 is larger, and therefore heavier, than the first sleeve portion 73, the force of gravity will cause the self-orienting sleeve 72 to rotate and/or slide about the pump intake 24 to take this orientation in the horizontal zone 30 of the wellbore 54. The self-orienting sleeve 71 allows liquid to flow smoothly uphole towards the pump intake 24, into the pump intake 24, and into the centrifugal pump 20 without disturbing the laminar flow of the liquid and without causing the liquid to become agitated and remixing with the gas.

In an embodiment, the self-orienting sleeve 71 may be retained within a race or channel or bearing of the pump intake 24 by a structure, for example a bracket, a retainer clip, or a retaining ring. In an embodiment, the self-orienting sleeve 71 and/or the pump intake 24 is provided with pin bearings or ball bearings that reduce the friction of the self-orienting sleeve 71 rotating and self-orienting based on the force of gravity.

Figure 3C:
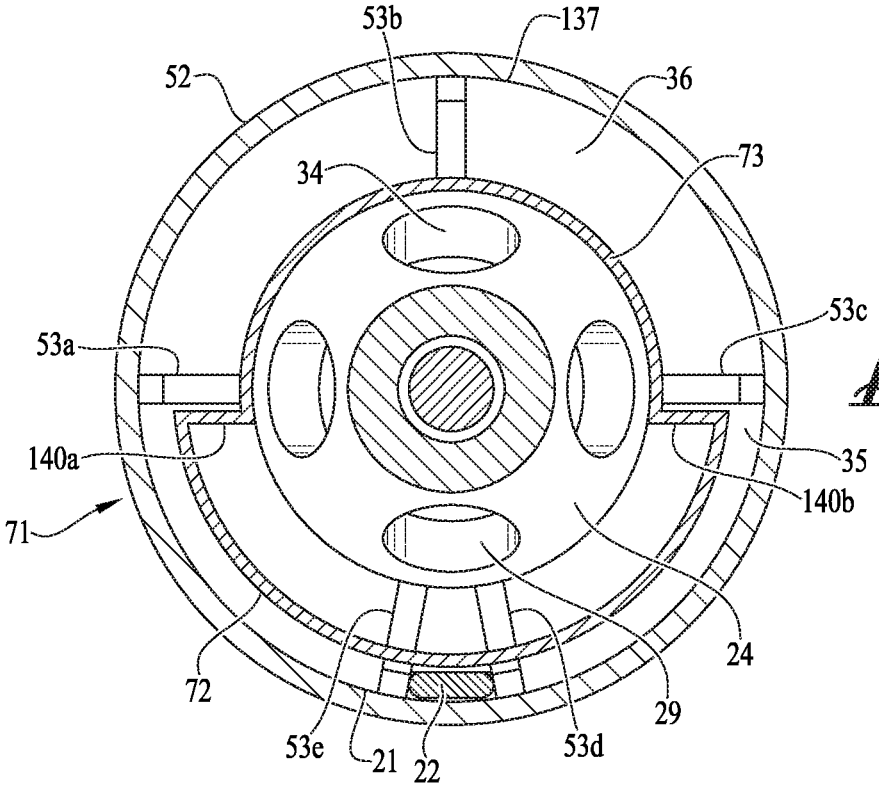

Turning now to FIG. 3C, the pump intake 24 and self-orienting sleeve 71 are shown in a rotational position where the electric cable 22 is proximate to a lower side 21 of the casing 52. The outside diameter of the second sleeve portion 72 allows room for the electric cable 22 when the second sleeve portion 72 hangs down towards the electric cable 22 as shown.

Figure 3D:
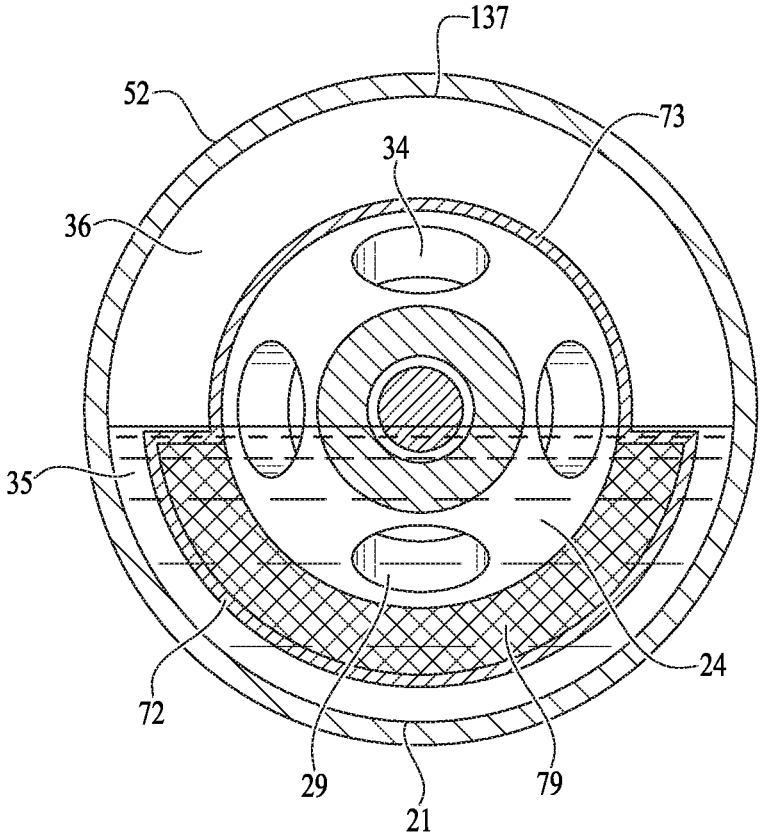

Turning now to FIG. 3D, another view of the self-orienting sleeve 71 is shown and described in the context where the upper part 36 of the casing 52 is filed with gas while the lower part 37 of the casing 52 is filled with liquid (at least downhole of the pump intake 24). There is a third gap 79 between the pump intake 24 and the second sleeve portion 72 allowing liquid to enter into the pump intake 24 while there is no gap between the pump intake 24 and the first sleeve portion, thereby preventing gas in the upper part 36 of the casing 52 from entering the pump intake 24. Since gas is not in the lower part 37 of the casing 52, gas is prevented from entering the pump intake 24. In other contexts, if the level of the liquid in the casing 52 is lower, some gas may enter the pump intake 24, but it is noted that the portion of the third gap 79 that gas may enter may be restricted by the presence of fluid.

Figure 4A:
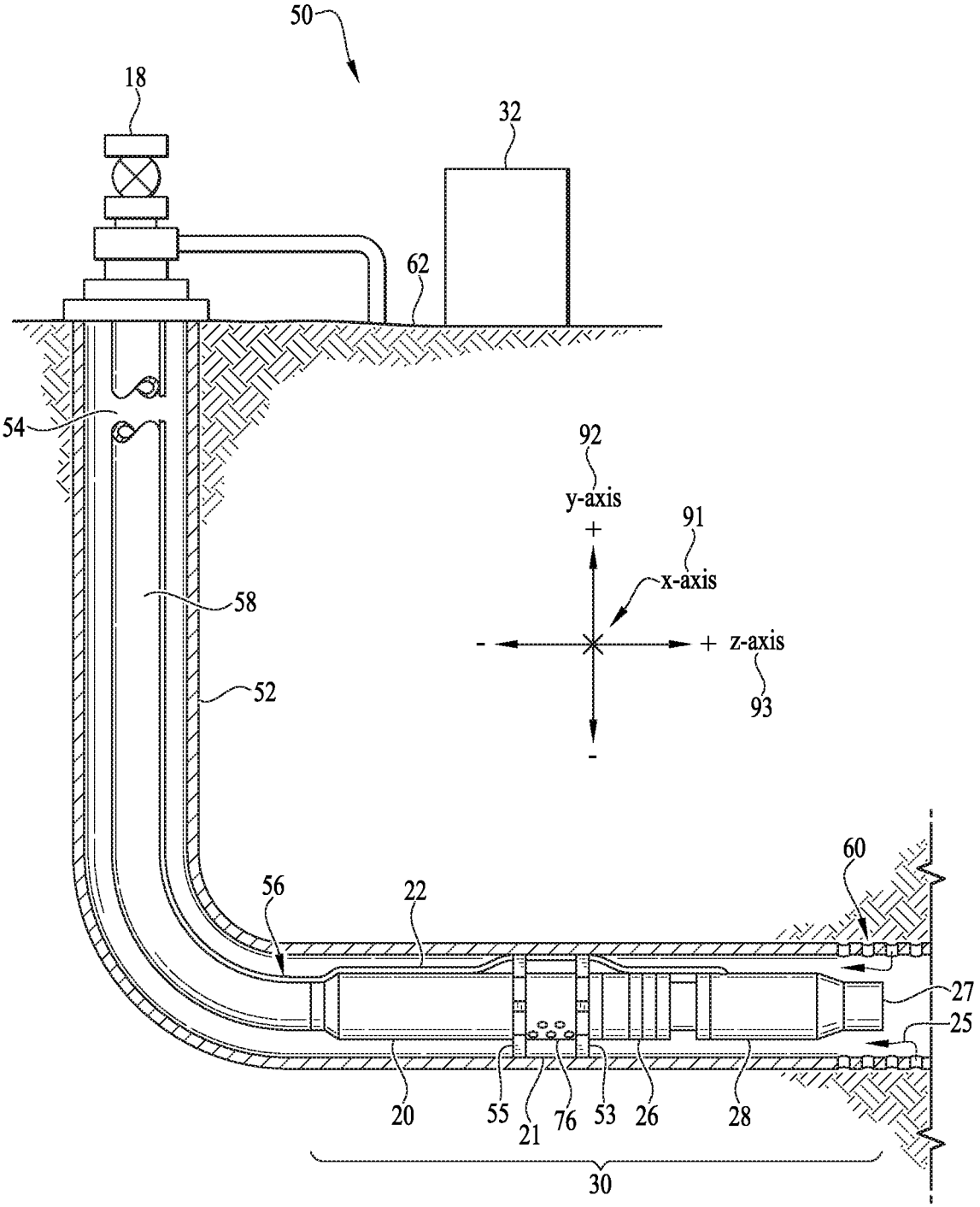
FIG. 4A is an illustration of another ESP assembly according to an embodiment of the disclosure.

Turning now to FIG. 4A, an alternative embodiment of the ESP assembly 56 is described. The production environment 50 of FIG. 4A comprises an operation station 32 at the surface 62 that receives outputs from the sensor package 27 that allows the operation station 32 to determine a rotational orientation of the ESP assembly 56 in the horizontal zone 30 of the wellbore 54. In an embodiment, the sensor package 27 may have one or more accelerometers that provide rotational position information to the operation station 32. While running in the ESP assembly 56 into the horizontal zone 30 of the wellbore 54, the rotational orientation of the ESP assembly 56 may be monitored at the operation station 32 and the production tubing 58 and ESP assembly 56 rotated incrementally to maintain the desired rotational alignment of the ESP assembly 56 within the horizontal zone 30 of the wellbore 54.

Figure 4B:
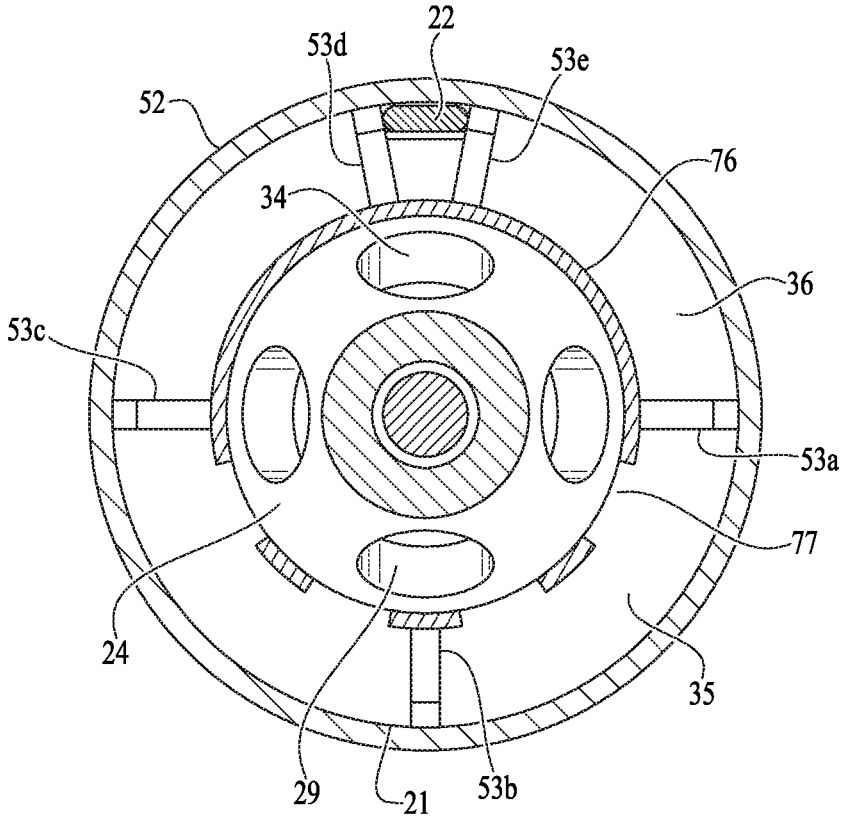
FIG. 4B is an illustration of a pump intake of an ESP assembly according to an embodiment of the disclosure.

As shown in FIG. 4A, the electric cable 22 desirably may be maintained proximate to the upper side 137 of the casing 52, for example by rotating the ESP assembly 56 during run in operations. Turning now to FIG. 4B, additionally, a sleeve 76, surrounding a pump intake 24, has ports 77 open proximate to a lower side 21 of the casing 52 and no ports open proximate the upper side 137 of the casing 52. The centralizers 53, 55 maintain the pump intake 24 up off the lower side 21 of the casing 52, to avoid the pump intake 24 disturbing the laminar flow of fluids flowing in the horizontal zone 30 of the wellbore 54. The fluid disposed in the lower portion 35 of the casing 52 flows into the ports 77 of the sleeve 76 and into the pump intake 24 while the gas suspended in the upper portion 36 of the horizontal zone 30 of the wellbore 54 is excluded from entering the sleeve 76 by the lack of ports in the area where the gas is located.

Figure 5:
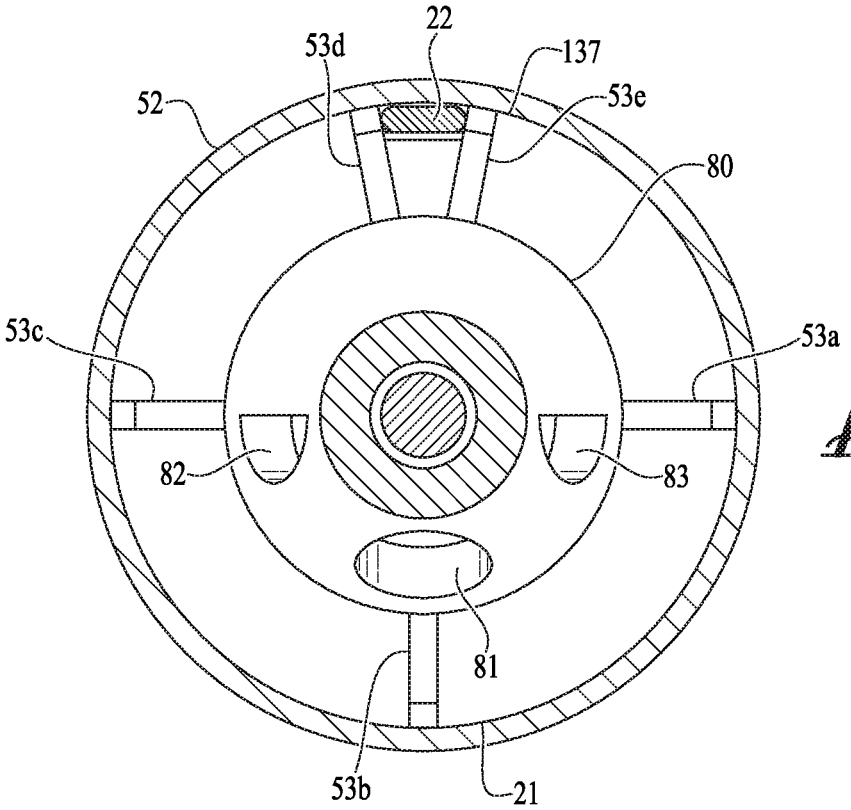
FIG. 5 is an illustration of another pump intake of an ESP assembly according to an embodiment of the disclosure.

Turning now to FIG. 5, a pump intake 80 is described, which may be used as an alternative to pump intake 24 of FIG. 1A. In an embodiment, the pump intake 80 defines a first inlet port 81, a second inlet port 82, and a third inlet port 83. The second inlet port 82 and the third inlet port 83 are half-circle (e.g., half-moon) shaped, and the first inlet port 81 is circular. The ports 81, 82, 83 are located on the same half of the pump intake 80. When the pump intake 80 is used in the ESP assembly 56, the rotational position of the ESP assembly 56 may be controlled during run-in as described above with reference to FIG. 4A to maintain the ports 81, 82, 83 downwards directed (i.e., facing towards the lower side 21 of the casing 52 and facing away from an upper side 137 of the casing 52) in the horizontal zone 30 of the wellbore 54. The pump intake 80 is held up off the casing 52 by centralizers and does not disturb the laminar flow of liquid flowing in the horizontal zone 30 of the wellbore 54. In other embodiments, the second inlet port 82 and the third inlet port 83 may have different shapes, for example triangular shaped, oval shaped, rectangular shaped, or other shapes.

Figure 6:
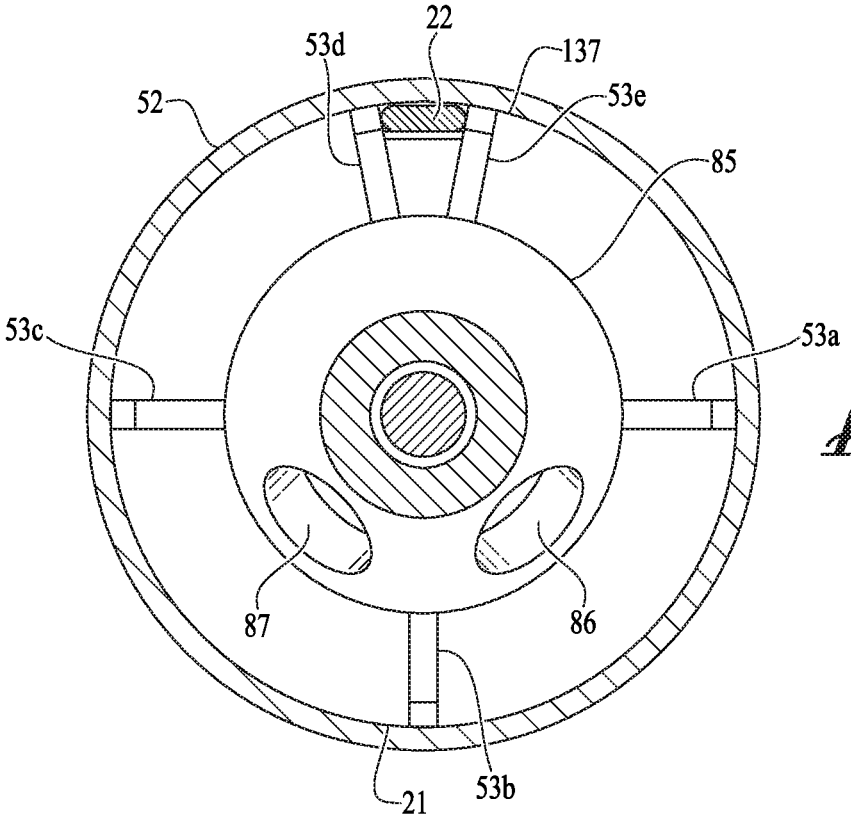
FIG. 6 is an illustration of yet another pump intake of an ESP assembly according to an embodiment of the disclosure.

Turning now to FIG. 6, a pump intake 85 is described, which may be used as an alternative to pump intake 24 of FIG. 1A. In an embodiment, the pump intake 85 defines a fourth inlet port 86 and a fifth inlet port 87, for example circular or oval shaped ports. The fourth and fifth inlet ports 86, 87 are located on the same half of the pump intake 85. When the pump intake 85 is used in the ESP assembly 56, the rotational position of the ESP assembly 56 may be controlled during run-in as described above with reference to FIG. 4A to maintain the inlet ports 86, 87 downwards directed (i.e., facing towards the lower side 21 of the casing 52 and facing away from an upper side 137 of the casing 52). The pump intake 85 is held off the casing 52 by centralizers and does not disturb the laminar flow of liquid flowing in the horizontal zone 30 of the wellbore 54. In an embodiment, the inlet ports 86, 87 may have different shapes, for example rectangular shaped, square shaped, triangular shaped, or other shapes.

Figure 7:
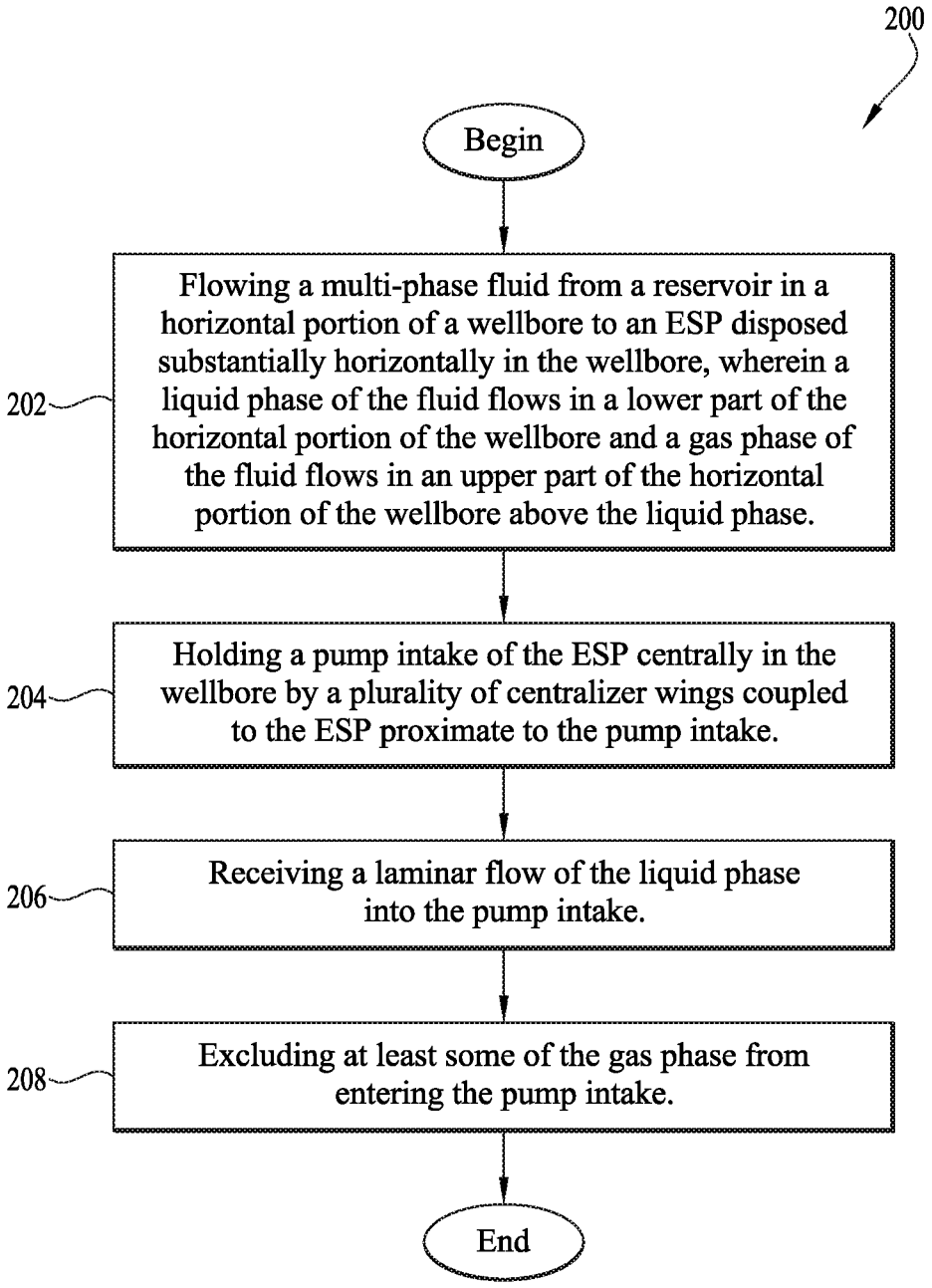
FIG. 7 is a flowchart of a method according to an embodiment of the disclosure.

Turning now to FIG. 7, a method 200 is described. In an embodiment, the method 200 is a method of producing reservoir fluid by an electric submersible pump (ESP) assembly. At block 202, the method 200 comprises flowing a multi-phase fluid from a reservoir in a horizontal portion of a wellbore to an ESP disposed substantially horizontally in the wellbore, wherein a liquid phase of the fluid flows in a lower part of the horizontal portion of the wellbore and a gas phase of the fluid flows in an upper part of the horizontal portion of the wellbore above the liquid phase.

At block 204, the method 200 comprises holding a pump intake of the ESP centrally in the wellbore by a plurality of centralizer wings coupled to the ESP proximate to the pump intake. The processing of block 204 may be accomplished by use of centralizers as described above with reference to FIG. 1A. At block 206, the method 200 comprises receiving a laminar flow of the liquid phase into the pump intake. The processing of block 206 may comprise avoiding disturbing the laminar flow of the liquid phase by keeping some or all of the ESP assembly from being in contact with the lower side (i.e., the side facing the center of the earth) of the casing in the wellbore.

At block 208, the method 200 comprises excluding at least some of the gas phase from entering the pump intake. In an embodiment, the processing of block 208 may comprise the self-orienting sleeve 57 of FIG. 2A, FIG. 2B, FIG. 2C, FIG. 2D, and FIG. 2E rotating around the pump intake 24 in response to the force of gravity as the ESP assembly 56 is run into the wellbore 54. In an embodiment, the processing of block 208 may comprise the self-orienting sleeve 71 of FIG. 3A, FIG. 3B, FIG. 3C, and FIG. 3D rotating around the pump intake 24 in response to the force of gravity as the ESP assembly 56 is run into the wellbore 54. The self-orienting sleeve 57, 71 may partially or fully gas from entering the pump intake 24 while allowing fluid to enter the pump intake 24. The processing of block 208 may comprise closing inlet ports of a pump intake of the ESP assembly directed away from the center of the earth by a self-orienting sleeve of the ESP assembly. Excluding gas phase fluid from entering the pump intake 24 may be accomplished by maintaining a predefined rotational alignment of the ESP assembly 56, as described further below, whereby inlet ports of a sleeve or the pump intake are aligned so as to exclude gas phase fluid entering the pump intake.

In an embodiment, the method 200 further comprises assembling the ESP assembly 56 at the surface 62. Assembling the ESP assembly 56 may comprise coupling the sensor package 27 to a downhole end of the electric motor 28, coupling the electric motor 28 to a downhole end of the seal section 26, coupling a downhole end of the pump intake 24 to the seal section 26, coupling a downhole end of the centrifugal pump 22, coupling the production tubing 58 to the centrifugal pump 22, and coupling the production tubing 58 to the wellhead 19. In an embodiment, the method 200 further comprises coupling the electric cable 22 to the electric motor 28. In an embodiment, the method 200 further comprises coupling the electric cable 22 to equipment located at the surface 62, for example electric power equipment and/or the operation station 32. The assembly of the ESP assembly 56 may be completed with tools and/or equipment in connection with a workover rig, a drilling rig, or other mast structure located proximate the wellbore 54 at the surface 62. Slips, threaded pipe subs, and other conventional apparatus may be used to hold and lift the ESP assembly 56 in the wellbore 54 during the succession of stages of assembly.

In an embodiment, the method 200 further comprises running the ESP assembly 56 into the wellbore 54 and landing the ESP assembly 56 in the horizontal portion 30 of the wellbore 54. As the ESP assembly 56 is run into the wellbore 54, joints of production tubing may be incrementally assembled into the production tubing 58. Alternatively, the ESP assembly 56 may be connected to coiled tubing, and the coiled tubing may be fed into the wellbore 54 from a coiled tubing spool.

In an embodiment, the method 200 may comprise receiving an indication of a rotational position of the ESP assembly 56 while the ESP assembly 56 is being run-in; maintaining a predefined rotational alignment of the ESP assembly 56 based on the indication of the rotational position while the ESP assembly 56 is being run-in; and setting the ESP assembly 56 into a completion position in the wellbore 54 in the predefined rotational alignment. For example, the sensor package 27 sends indications of rotational alignment to the operation station 32 at the surface 62 (e.g., via wireless communication link or via the electric cable 22). An operator at the surface 62 monitors the rotational alignment of the ESP assembly 56 from the operation station 32 and commands rotational adjustments to the ESP assembly 56 based on the indications of rotational alignment of the ESP assembly 56. By controlling and adjusting the rotational alignment of the ESP assembly 56 and being aware of when the ESP assembly 56 is approaching completion depth, the operator can controllably set the ESP assembly 56 in completion position in the predefined rotational alignment. In an embodiment, the predefined rotational alignment is the rotational position in which the ports 77 of FIG. 4B are directed towards the lower side 21 of the casing 52, in which the first inlet port 82 of the pump intake 80 of FIG. 5 are directed towards the lower side 21 of the casing 52, or in which the inlet ports 86, 87 of the pump intake 85 of FIG. 6 are directed towards the lower side 21 of the casing 52.

In an embodiment, method 200 further comprises at least one of holding an electric motor of the ESP assembly centrally in the wellbore by a plurality of centralizer wings coupled to the ESP assembly proximate to the electric motor; holding a centrifugal pump of the ESP assembly centrally in the wellbore by a plurality of centralizer wings coupled to the ESP assembly proximate to the centrifugal pump; or holding a seal section of the ESP assembly centrally in the wellbore by a plurality of centralizer wings coupled to the ESP assembly proximate to the seal section.

For example, the centralizers 53 described above with reference to FIG. 2A, FIG. 2B, FIG. 2C, FIG. 2D, FIG. 3A, FIG. 3B, FIG. 3C, FIG. 4B. FIG. 5, and FIG. 6, may be used to hold one or more components of the ESP assembly 56 centrally in the casing 52. Holding the ESP assembly 56 centrally in the casing 52 may help to promote maintaining laminar flow of the liquid phase fluid and prevent or reduce remixing of liquid and gas.

Figure 8:
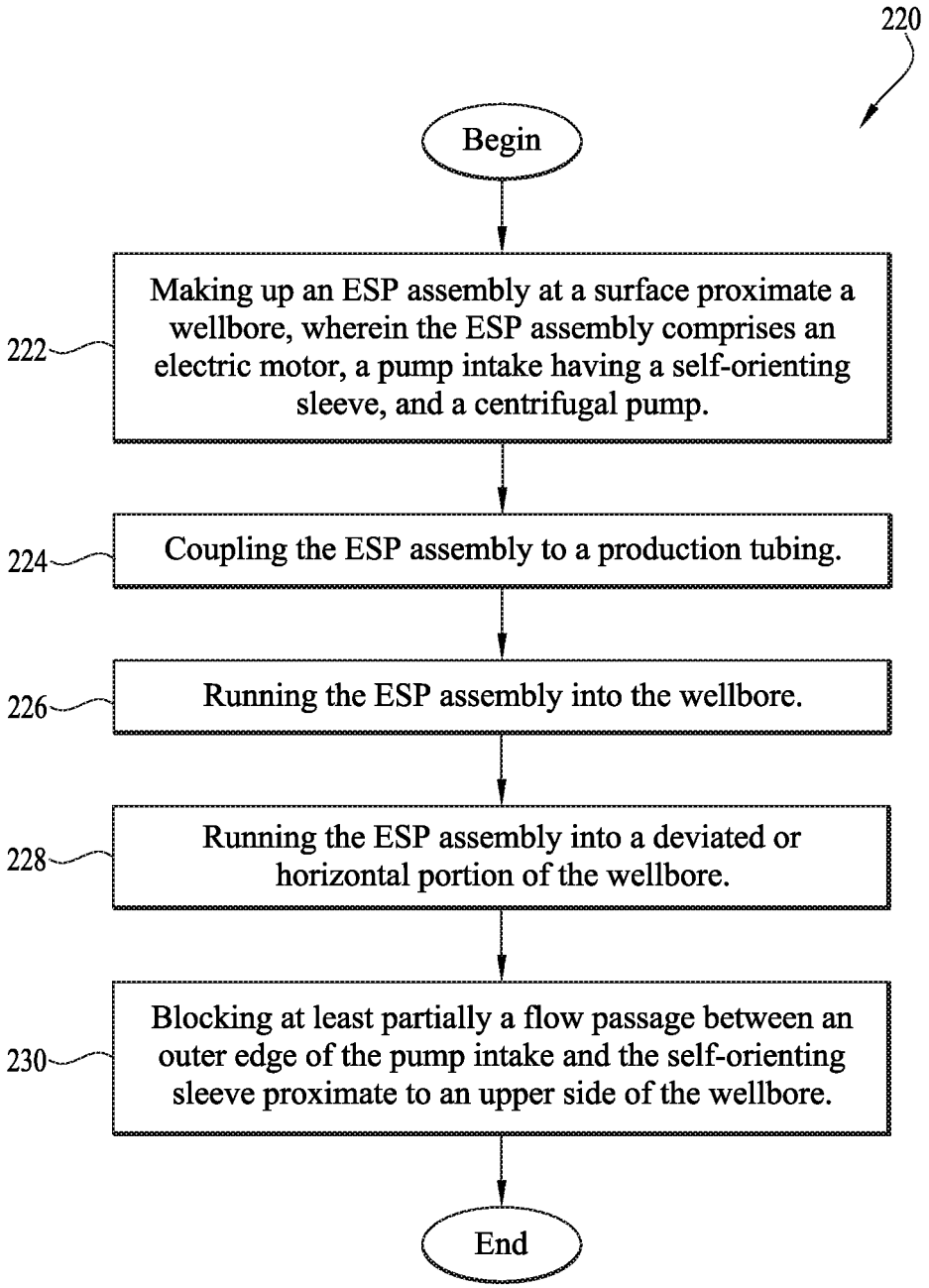
FIG. 8 is a flowchart of another method according to an embodiment of the disclosure.

Turning now to FIG. 8, a method 220 is described. In an embodiment, the method 220 is a method of installing an ESP assembly in a wellbore, for example installing the ESP assembly 56 in the wellbore 54. At block 222, the method 220 comprises making up an ESP assembly at a surface proximate a wellbore, wherein the ESP assembly comprises an electric motor, a pump intake having a self-orienting sleeve, and a centrifugal pump. See above discussion of assembling the ESP assembly 56 with reference to method 200 above.

At block 224, the method 200 comprises coupling the ESP assembly to a production tubing, for example coupling ESP assembly 56 to production tubing 58. At block 226, the method 200 comprises running the ESP assembly into the wellbore.

At block 228, the method 200 comprises running the ESP assembly into a deviated or horizontal portion of the wellbore. In an embodiment, the processing of blocks 226 and 228 may be performed as the same processing block, but they are separated here to call attention to the behavior of the self-orienting sleeve. As the ESP assembly 56 begins to deviate from a vertical orientation as the run-in progressively deviates from vertical, the self-orienting sleeve 57, 71 of the pump intake 24 is moved by force of gravity. In the case of the embodiment described with reference to FIG. 2A, FIG. 2B, FIG. 2C, FIG. 2D, and FIG. 2E, the self-orienting sleeve 57 hangs down on the pump intake 24 towards the lower side 21 of the casing 52. In the case of the embodiment described with reference to FIG. 3A, FIG. 3B, FIG. 3C, and FIG. 3D, the self-orienting sleeve 71 rotates so the second sleeve portion 72 is proximate the lower side 21 of the casing 52 and the first sleeve portion 73 is proximate the upper side 137 of the casing 52.

At block 230, the method 200 comprises blocking at least partially a flow passage between an outer edge of the pump inlet and the self-orienting sleeve proximate to an upper side of the wellbore. For example, the passageway between the outer edges 136 of the pump intake is at least partially blocked by the self-orienting sleeve 57, 71. In this way, gas may be prevented from entering the pump intake 24 or the amount of gas entering the pump intake 24 may be reduced.

In an embodiment, the method 220 further comprises receiving liquid into an inlet port of the pump intake of the ESP assembly directed toward the lower side of the casing and lifting the liquid to the surface by the centrifugal pump.

Figure 9:
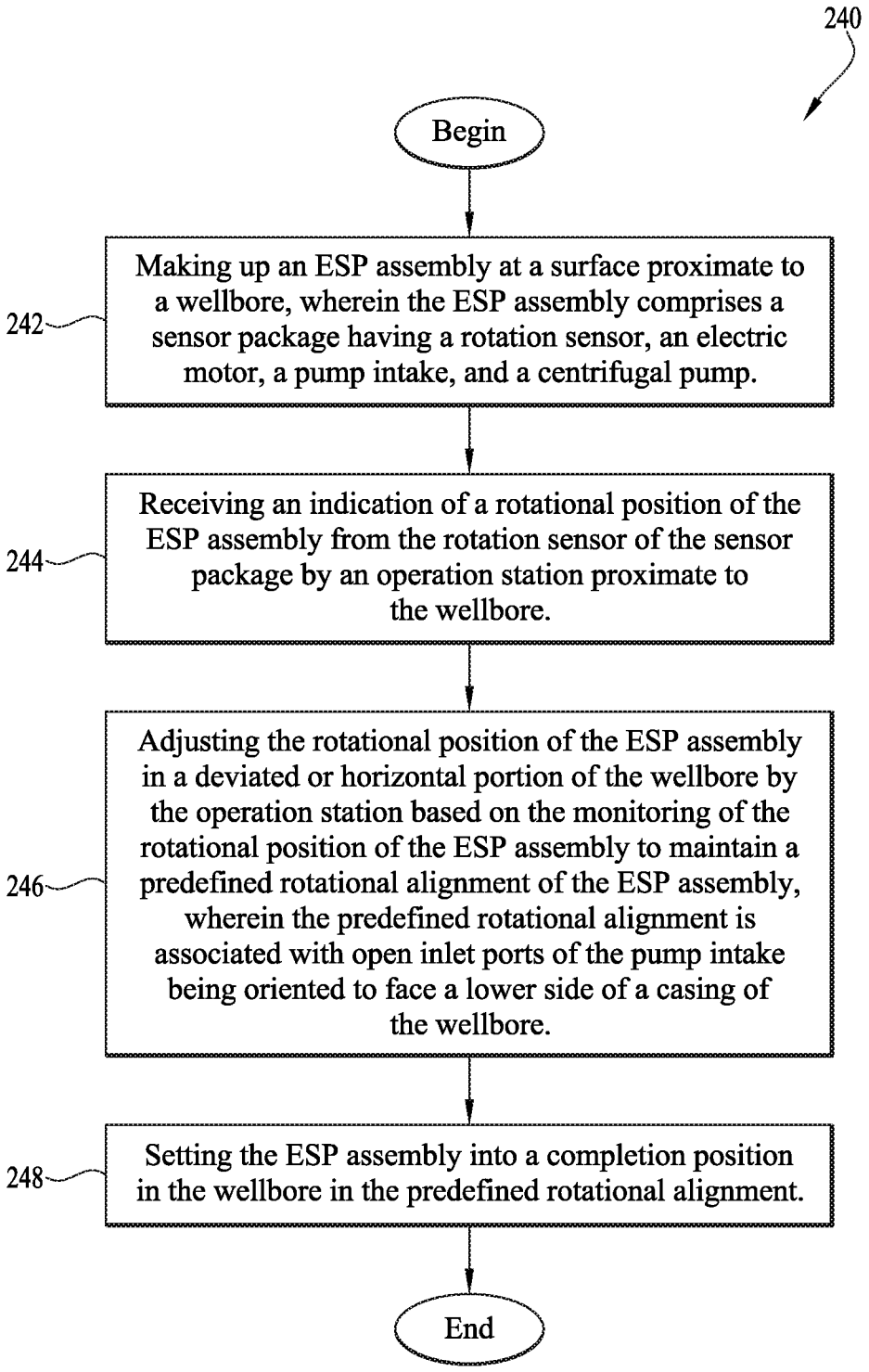
FIG. 9 is a flowchart of yet another method according to an embodiment of the disclosure.

Turning now to FIG. 9, a method 240 is described. In an embodiment, the method 240 is a method of installing an electric submersible pump (ESP) assembly in a wellbore. At block 242, the method 240 comprises making up an ESP assembly at a surface proximate to a wellbore, wherein the ESP assembly comprises a sensor package having a rotation sensor, an electric motor, a pump intake, and a centrifugal pump. See above discussion of assembling the ESP assembly 56 with reference to method 200 above.

At block 244, the method 240 comprises receiving an indication of a rotational position of the ESP assembly from the rotation sensor of the sensor package by an operation station proximate to the wellbore. For example, an accelerometer of the sensor package 27 sends an indication of rotational position to the operation station 32 depicted in FIG. 4A. At block 246, the method 240 comprises adjusting the rotational position of the ESP assembly in a deviated or horizontal portion of the wellbore by the operation station based on the monitoring the rotational position of the ESP assembly to maintain a predefined rotational alignment of the ESP assembly, wherein the predefined rotational alignment is associated with open inlet ports of the pump intake being oriented to face a lower side of a casing of the wellbore. The predefined rotational alignment may correspond to the alignment of the pump intake 24 and sleeve 76 shown in FIG. 4B. The predefined rotational alignment may correspond to the alignment of the pump intake 80 shown in FIG. 5. The predefined rotational alignment may correspond to the alignment of the pump intake 85 shown in FIG. 6. For example, based on the indication of rotational position of the ESP assembly 56, a tool located at the surface 62 is operated to rotate the ESP assembly 56 in the wellbore 54 to achieve and/or maintain the predefined rotational alignment of the ESP assembly 56. At block 248, the method 240 comprises setting the ESP assembly into a completion position in the wellbore in the predefined rotational alignment. For example, the ESP assembly 56 is placed in a deviated wellbore or a horizontal wellbore at a completion depth and the production tubing 58 coupled to the wellhead 18.

The teachings above are directed, in part, to avoiding disturbing laminar flow of liquid phase fluid in a substantially horizontal wellbore by an ESP assembly by keeping at least some portions of the ESP assembly, for example the pump intake, up off of the casing in the horizontal portion of the wellbore. The teachings above further are directed to closing or partially blocking inlet ports of the pump intake that are disposed in the gas phase fluid are of the horizontal wellbore. When the reservoir fluid is not disturbed and maintains laminar flow, the natural separation of gas phase fluid from liquid phase fluid of produced reservoir fluid (e.g., the gas phase remains in an upper portion of the horizontal casing while the liquid phase remains in the lower portion of the horizontal casing) can be benefited from by selectively admitting reservoir fluid in the lower portion of the casing, thereby reducing the gas to liquid ratio of the fluid provided to the intake of the centrifugal pump. This reduced gas to liquid ratio can improve the efficiency of the centrifugal pump and reduce wear on the centrifugal pump.

In a first aspect an electric submersible pump (ESP) assembly comprises a pump intake defining a plurality of intake ports disposed circumferentially around the pump intake, a first plurality of centralizer wings disposed radially about the pump intake on a downhole side of the intake ports, and a second plurality of centralizer wings disposed radially about the pump intake on an uphole side of the intake ports. In a second aspect, the first aspect further comprises a sleeve disposed around the outside of the pump intake wherein the sleeve defines apertures in one half of the sleeve and does not define apertures in the other half of the sleeve. In an third aspect, the sleeve of the second aspect is rotationally fixed to the pump inlet.

Additional Disclosure

The following are non-limiting, specific embodiments in accordance with the present disclosure:

A first embodiment, which is an electric submersible pump (ESP) assembly, comprising a pump intake defining a plurality of intake ports disposed circumferentially around the pump intake, a first plurality of centralizer wings disposed radially about the pump intake on a downhole side of the intake ports, a second plurality of centralizer wings disposed radially about the pump intake on an uphole side of the intake ports, and a self-orienting sleeve disposed around the intake ports, positioned between the first and second plurality of centralizer wings, and free to contact and block upward facing intake ports when the ESP assembly is disposed in a horizontal or offset position.

A second embodiment, which is the ESP assembly of the first embodiment, wherein the ESP assembly further comprises an electric motor, a seal section coupled to the electric motor and to the pump intake, and a centrifugal pump mechanically coupled to the pump intake and the electric motor.

A third embodiment, which is the ESP assembly of the second embodiment, wherein a third plurality of centralizers are coupled to at least one of the electric motor, the seal section, and the centrifugal pump.

A fourth embodiment, which is the ESP assembly of the first, the second, or the third embodiment, further comprising a sensor package having at least one accelerometer.

A fifth embodiment, which is the ESP assembly of the first, the second, the third, or the fourth embodiment, wherein the self-orienting sleeve has a cross-sectional shape of a circular cylinder.

A sixth embodiment, which is the ESP assembly of the first, the second, the third, or the fourth embodiment, wherein the self-orienting sleeve comprises a first sleeve portion that has a cross-section of a portion of a circle having a diameter about the same as the diameter of the pump intake and a second sleeve portion that has a cross-section of a portion of a circle having a diameter larger than the diameter of the pump intake and having a radius less than the distance of the inner surface of an electric cable of the ESP assembly as it passes over the pump intake.

A seventh embodiment, which is the ESP assembly of the first, the second, the third, the fourth, the fifth, or the sixth embodiment, wherein the electric cable passes over the pump intake between two of the first plurality of centralizer wings located proximate to the electric cable and between two of the second plurality of centralizer wings located proximate to the electric cable.

An eighth embodiment, which is an electric submersible pump (ESP) assembly, comprising a cylindrical pump intake that is solid on a first side defining about 180 degrees of the cylinder and having a plurality of intake ports on an opposite side defining another about 180 degrees of the cylinder, a first plurality of centralizer wings disposed radially about the pump intake on a downhole side of the intake ports, and a second plurality of centralizer wings disposed radially about the pump intake on an uphole side of the intake ports.

A ninth embodiment, which is the ESP assembly of the eighth embodiment, wherein the ESP assembly further comprises an electric motor, a seal section coupled to the electric motor and to the pump intake, a centrifugal pump mechanically coupled to the pump intake and the electric motor, and a sensor package having at least one accelerometer.

A tenth embodiment, which is the ESP assembly of the ninth embodiment, wherein a third plurality of centralizers are coupled to at least one of the electric motor, the seal section, and the centrifugal pump.

An eleventh embodiment, which is the ESP assembly of the eighth, the ninth, or the tenth embodiment, wherein an electric cable passes over the pump intake between two of the first plurality of centralizer wings located proximate to the electric cable and between two of the second plurality of centralizer wings located proximate to the electric cable.

A twelfth embodiment, which is the ESP assembly of the eighth, the ninth, the tenth, or the eleventh embodiment, wherein the first and second plurality of centralizer wings comprise iron, steel, stainless steel, carbide metal, or titanium metal.

A thirteenth embodiment, which is the ESP assembly of the eighth, the ninth, the tenth, the eleventh, or the twelfth embodiment, wherein the centralizer wings extend at least about 0.5 inch and no more than about 2.0 inches outward from the pump intake toward a wellbore wall.

A fourteenth embodiment, which is a method of producing reservoir fluid by an electric submersible pump (ESP) assembly, comprising flowing a multi-phase fluid from a reservoir in a horizontal portion of a wellbore to an ESP assembly disposed substantially horizontally in the wellbore, wherein a liquid phase of the fluid flows in a lower part of the horizontal portion of the wellbore and a gas phase of the fluid flows in an upper part of the horizontal portion of the wellbore above the liquid phase, holding a pump intake of the ESP assembly centrally in the wellbore by a plurality of centralizer wings coupled to the ESP assembly proximate to the pump intake, receiving a laminar flow of the liquid phase into the pump intake, and excluding at least some of the gas phase from entering the pump intake.

A fifteenth embodiment, which is the method of the fourteenth embodiment, further comprising running the ESP assembly into the horizontal portion of the wellbore, receiving an indication of a rotational position of the ESP assembly while the ESP assembly is being run-in, maintaining a predefined rotational alignment of the ESP assembly based on the indication of the rotational position while the ESP assembly is being run-in, and setting the ESP assembly into a completion position in the wellbore in the predefined rotational alignment.

A sixteenth embodiment, which is the method the fourteenth embodiment, further comprising running the ESP assembly into the horizontal portion of the wellbore, and closing inlet ports of a pump intake of the ESP assembly directed away from the center of the earth by a self-orienting sleeve of the ESP assembly.

A seventeenth embodiment, which is the method of the fourteenth, the fifteenth, or the sixteenth embodiment, further comprising at least one of holding an electric motor of the ESP assembly centrally in the wellbore by a plurality of centralizer wings coupled to the ESP assembly proximate to the electric motor; holding a centrifugal pump of the ESP assembly centrally in the wellbore by a plurality of centralizer wings coupled to the ESP assembly proximate to the centrifugal pump; or holding a seal section of the ESP assembly centrally in the wellbore by a plurality of centralizer wings coupled to the ESP assembly proximate to the seal section.

An eighteenth embodiment, which is a method of installing an electric submersible pump (ESP) assembly in a wellbore, comprising making up an ESP assembly at a surface proximate a wellbore, wherein the ESP assembly comprises an electric motor, a pump intake having a self-orienting sleeve, and a centrifugal pump, coupling the ESP assembly to a production tubing, running the ESP assembly into the wellbore, running the ESP assembly into a deviated or horizontal portion of the wellbore, and blocking at least partially a flow passage between an outer edge of the pump intake and the self-orienting sleeve proximate to an upper side of the wellbore.

A nineteenth embodiment, which is the method of the eighteenth embodiment, further comprising receiving liquid into an inlet port of the pump intake of the ESP assembly directed toward the lower side of the casing and lifting the liquid to the surface by the centrifugal pump.

A twentieth embodiment, which is a method of installing an electric submersible pump (ESP) assembly in a wellbore, comprising making up an ESP assembly at a surface proximate to a wellbore, wherein the ESP assembly comprises a sensor package having a rotation sensor, an electric motor, a pump intake, and a centrifugal pump, receiving an indication of a rotational position of the ESP assembly from the rotation sensor of the sensor package by an operation station proximate to the wellbore, adjusting the rotational position of the ESP assembly in a deviated or horizontal portion of the wellbore by the operation station based on the monitoring the rotational position of the ESP assembly to maintain a predefined rotational alignment of the ESP assembly, wherein the predefined rotational alignment is associated with open inlet ports of the pump intake being oriented to face a lower side of a casing of the wellbore, and setting the ESP assembly into a completion position in the wellbore in the predefined rotational alignment.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

a pump intake defining a plurality of intake ports disposed circumferentially around the pump intake;

a first plurality of centralizer wings disposed radially about the pump intake on a downhole side of the intake ports;

a second plurality of centralizer wings disposed radially about the pump intake on an uphole side of the intake ports; and a self-orienting sleeve disposed around the intake ports, positioned between the first and second plurality of centralizer wings, and free to contact and block upward facing intake ports when the ESP assembly is disposed in a horizontal or offset position, wherein the self-orienting sleeve comprises a first sleeve portion that has a cross-section of a portion of a circle having an inner diameter sized to contact an outer diameter of the pump intake and a second sleeve portion that has a cross-section of a portion of a circle having an inner diameter larger than the outer diameter of the pump intake and having a radius less than the distance of the inner surface of an electric cable of the ESP assembly as it passes over the pump intake.

2. The ESP assembly of claim 1, wherein the ESP assembly further comprises:

an electric motor;

a seal section coupled to the electric motor and to the pump intake; and a centrifugal pump mechanically coupled to the pump intake and the electric motor.

3. The ESP assembly of claim 2, further comprising a sensor package having at least one accelerometer.

4. The ESP assembly of claim 2, wherein a third plurality of centralizer wings are coupled to at least one of the electric motor, the seal section, and the centrifugal pump.

5. The ESP assembly of claim 4, wherein the self-orienting sleeve has a cross-sectional shape of a circular cylinder.

6. The ESP assembly of claim 1, further comprising a sensor package having at least one accelerometer.

7. The ESP assembly of claim 1, wherein the self-orienting sleeve has a cross-sectional shape of a circular cylinder.

8. The ESP assembly of claim 1, wherein the electric cable passes over the pump intake between two of the first plurality of centralizer wings located proximate to the electric cable and between two of the second plurality of centralizer wings located proximate to the electric cable.

9. The ESP assembly of claim 8, further comprising a sensor package having at least one accelerometer.

10. The ESP assembly of claim 8, wherein the self-orienting sleeve has a cross-sectional shape of a circular cylinder.

11. An electric submersible pump (ESP) assembly, comprising:

a cylindrical pump intake that is solid on a first side defining 180 degrees of the cylinder and having a plurality of intake ports on an opposite side defining another 180 degrees of the cylinder;

a first plurality of centralizer wings disposed radially about the pump intake on a downhole side of the intake ports; and a second plurality of centralizer wings disposed radially about the pump intake on an uphole side of the intake ports, wherein an electric cable passes over the pump intake between two of the first plurality of centralizer wings located proximate to the electric cable and between two of the second plurality of centralizer wings located proximate to the electric cable.

12. The ESP assembly of claim 11, wherein the ESP assembly further comprises:

an electric motor;

a seal section coupled to the electric motor and to the pump intake;

a centrifugal pump mechanically coupled to the pump intake and the electric motor; and a sensor package having at least one accelerometer.

13. The ESP assembly of claim 12, wherein the first and second plurality of centralizer wings comprise iron, steel, stainless steel, carbide metal, or titanium metal.

14. The ESP assembly of claim 12, wherein a third plurality of centralizer wings are coupled to at least one of the electric motor, the seal section, and the centrifugal pump.

15. The ESP assembly of claim 14, wherein the centralizer wings extend at least 0.5 inch and no more than 2.0 inches outward from the pump intake toward a wellbore wall.

16. The ESP assembly of claim 11, wherein the first and second plurality of centralizer wings comprise iron, steel, stainless steel, carbide metal, or titanium metal.

17. The ESP assembly of claim 11, wherein the centralizer wings extend at least 0.5 inch and no more than 2.0 inches outward from the pump intake toward a wellbore wall.

18. A method of producing reservoir fluid by an electric submersible pump (ESP) assembly, comprising:

flowing a multi-phase fluid from a reservoir in a horizontal portion of a wellbore to an ESP assembly disposed substantially horizontally in the wellbore, wherein a liquid phase of the fluid flows in a lower part of the horizontal portion of the wellbore and a gas phase of the fluid flows in an upper part of the horizontal portion of the wellbore above the liquid phase;

holding a pump intake of the ESP assembly centrally in the wellbore by a plurality of centralizer wings coupled to the ESP assembly proximate to the pump intake;

receiving a laminar flow of the liquid phase into the pump intake; and excluding at least some of the gas phase from entering the pump intake, further comprising:

running the ESP assembly into the horizontal portion of the wellbore;

receiving an indication of a rotational position of the ESP assembly while the ESP assembly is being run-in;

maintaining a predefined rotational alignment of the ESP assembly based on the indication of the rotational position while the ESP assembly is being run-in; and setting the ESP assembly into a completion position in the wellbore in the predefined rotational alignment.

19. The method of claim 18, further comprising:

closing inlet ports of a pump intake of the ESP assembly directed away from the center of the earth by a self-orienting sleeve of the ESP assembly.

20. The method of claim 18, further comprising at least one of holding an electric motor of the ESP assembly centrally in the wellbore by a plurality of centralizer wings coupled to the ESP assembly proximate to the electric motor; holding a centrifugal pump of the ESP assembly centrally in the wellbore by a plurality of centralizer wings coupled to the ESP assembly proximate to the centrifugal pump; or holding a seal section of the ESP assembly centrally in the wellbore by a plurality of centralizer wings coupled to the ESP assembly proximate to the seal section.

* * * * *